United States Patent [19]

Röhm

[11] 4,323,085

[45] Apr. 6, 1982

[54] HAIR DYEING APPARATUS

[76] Inventor: Fritz Röhm, Rechte Brandstr. 49, 8900 Augsburg, Fed. Rep. of Germany

[21] Appl. No.: 175,919

[22] Filed: Aug. 6, 1980

Related U.S. Application Data

[63] Continuation of Ser. No. 955,183, Oct. 27, 1978, abandoned.

[30] Foreign Application Priority Data

Nov. 2, 1977 [DE] Fed. Rep. of Germany ..... 2749074
Jun. 3, 1978 [DE] Fed. Rep. of Germany ..... 2824525

[51] Int. Cl.[2] ..... A45D 24/22
[52] U.S. Cl. ..... 132/113
[58] Field of Search ..... 132/113–116, 132/9

[56] References Cited

U.S. PATENT DOCUMENTS 2,259,931 10/1941 Griffith ..... 132/113
2,381,048 8/1945 Habostad ..... 132/113
3,463,170 8/1969 McCallough ..... 132/113
4,121,602 10/1978 Young ..... 132/113

*Primary Examiner*—G. E. McNeill
*Attorney, Agent, or Firm*—Karl F. Ross

[57] ABSTRACT

An apparatus for treating (e.g. dyeing) hair, utilizing a treatment liquid which is a mixture of several components, has a cylindrical container with an open end to which an attachment with a hollow comb structure for the discharge of the liquid mixture is threadedly secured. The discharge is effected by the release of a spring-loaded piston inside the container from a retracted position. To mix the several components, a perforated disc may be axially reciprocated in the container between the piston head and the attachment; the disc may have a stem passing through the hollow piston rod to the outside and terminating in a manipulating knob which in one embodiment may be rotated relatively to the piston into a position wherein the perforations of the disc are aligned with similar perforations of the piston head so that mixing is accomplished by joint reciprocation of that head and the disc.

8 Claims, 12 Drawing Figures

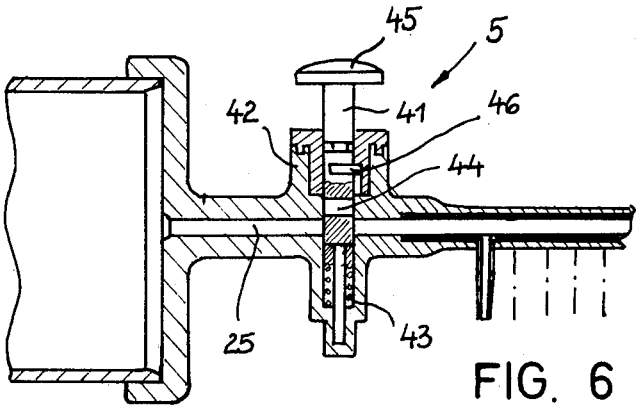
FIG. 6
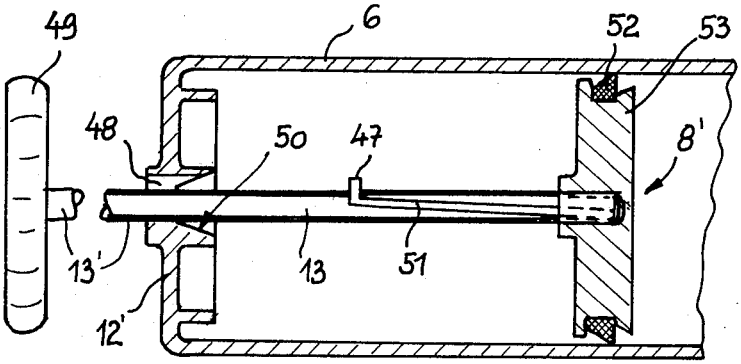
FIG. 7
FIG. 8
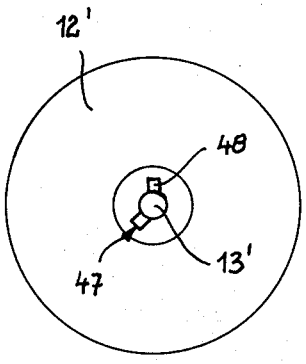

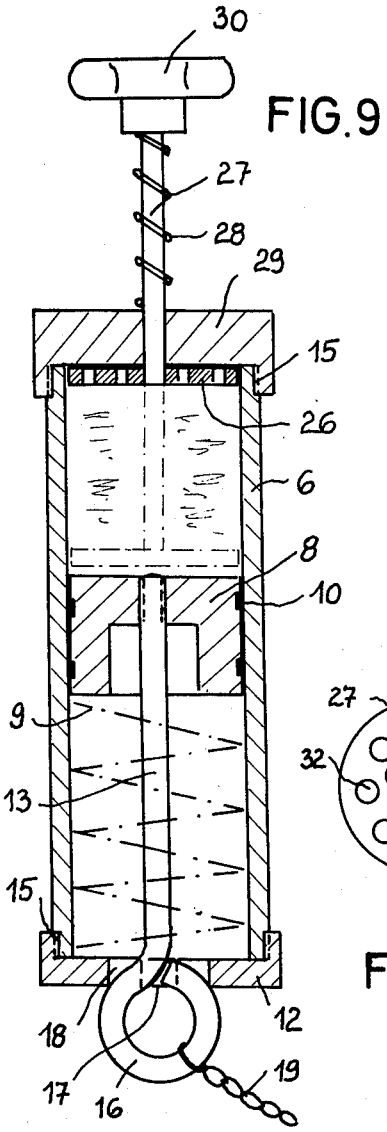
FIG. 9
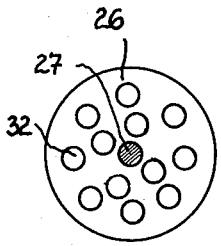
FIG. 11
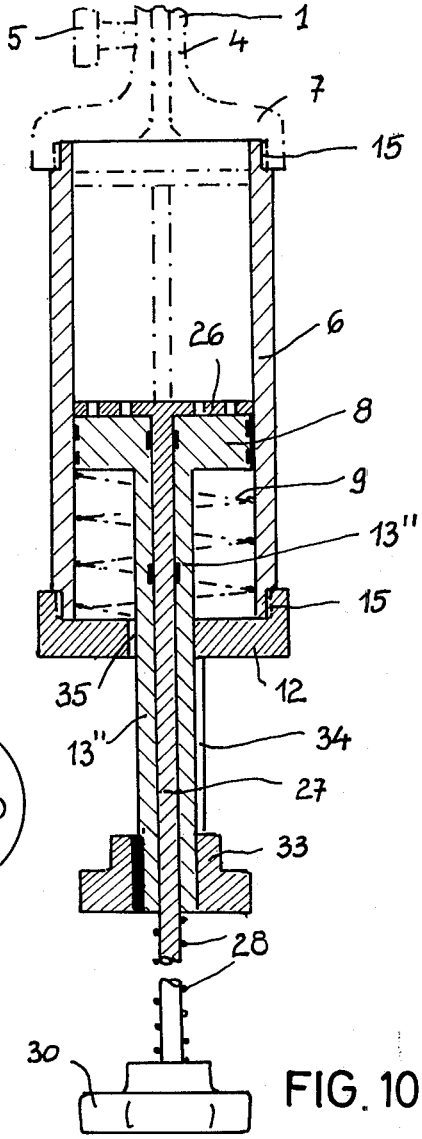
FIG. 10
FIG. 12
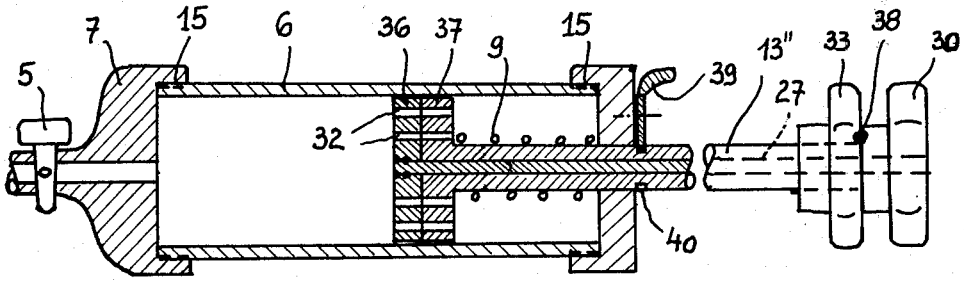

HAIR DYEING APPARATUS

This is a continuation of application Ser. No. 955,183, filed Oct. 27, 1978 now abandoned.

FIELD OF THE INVENTION

My present invention relates to hair-dyeing apparatus, comprising a hollow comb element with hollow tines connected to the interior thereof and a receptacle which is, connected to the comb element and contains the hair-dyeing medium while having movably guided therein a piston adapted to convey the hair-dyeing medium into the comb element.

BACKGROUND OF THE INVENTION

An apparatus of this kind is known from German Pat. No. 857,852 which discloses two cylinders, guided coaxially with respect to each other, the outer cylinder supporting a piston rod guided together with the piston in the inner cylinder to which the comb element is threadedly connected. Manual relative displacement of the two cylinders generates the pressure which allows the hair-dyeing medium to enter through the comb element into the hollow tines. However, this requires the operator to manually perform two motions which are different from each other, namely on the one hand to guide the comb element in the correct manner through the hair tufts which are to be dyed and on the other hand to simultaneously feed the necessary amount of hair-dyeing medium into the comb element. Expert dyeing is not possible with such apparatus.

U.S. Pat. No. 2,603,233 discloses a hair-dyeing apparatus in which a housing, provided with a spring-biased piston and adapted to contain the hair-treatment liquid, must be set in rotation about its longitudinal axis by means of a handle and against the action of a torsion spring in order to open a stop valve by means of such rotation so that the liquid pressurized by the piston can be conveyed into a hollow comb member. The tines of the comb member participate in the rotation but the liquid cannot be conducted therethrough. Instead, the liquid passes through pads or other absorbent strips which are attached to the outside of the comb member. It is evidently the intention that rotation of the comb member will comb through the hair which is simultaneously wetted with the liquid by means of the pads. Such an awkward procedure is also unsuitable in practical operation.

OBJECTS OF THE INVENTION

It is therefore an object of my invention to design a hair-dyeing apparatus in such a way that the hair can be dyed more rapidly and can be more uniformly coated while handling of the apparatus is substantially simplified.

It is another object to provide simple means for feeding the hair-dyeing medium to the hair in metered form and for varying the metering in a simple manner in accordance with requirements.

Finally, it is an object of the invention to provide means in such apparatus for mixing the hair-dyeing or hair-toning medium, usually comprising two components, homogeneously in a particularly simple manner.

SUMMARY OF THE INVENTION

An apparatus according to my invention comprises a cylindrical container having an open end closable by an attachment which forms a tube with lateral apertures communicating with the interior of the container whereby a treatment liquid can be discharged through these apertures by the advance of a piston which is biased toward that open end and whose piston head can be temporarily retained in a retracted position by suitable locking means. Before release of the locking means to discharge the liquid, several components can be thoroughly intermixed in the same container with the aid of a perforated agitator disc received between the open end thereof and the piston head, the disc being provided with a stem which passes axially through a bore in the piston head and terminates outside the container in a manipulating knob whereby the disc can be axially reciprocated.

In an advantageous embodiment described hereinafter, the disc is in permanent contact with the piston head which has perforations aligned with those of the disc in one relative rotary position and disaligned therefrom in another relative rotary position, the disc and the piston head being jointly reciprocable for mixing the components of the treatment liquid in their position of alignment and for discharging the liquid in their position of disalignment.

BRIEF DESCRIPTION OF THE DRAWING

The above and other features of my invention will now be described in detail with reference to the FIG. 1 is a longitudinal section through a hair-dyeing apparatus according to the invention;

FIG. 6 is a longitudinal section through a comb element with a specific reducing valve;

FIG. 7 is a longitudinal section through a container in which the piston rod is locked by means of a cross-pin;

FIG. 8 is an end view of the container with the locking means according to FIG. 7;

FIG. 9 is a longitudinal section through a hair-dyeing apparatus with a mixing device;

FIG. 10 is a longitudinal section through a modification of the arrangement according to FIG. 9;

FIG. 11 is a plan view of a mixing element constructed as a perforated plate; and FIG. 12 is a longitudinal section through another modification of the hair-dyeing apparatus according to my invention.

SPECIFIC DESCRIPTION

Figure 1:
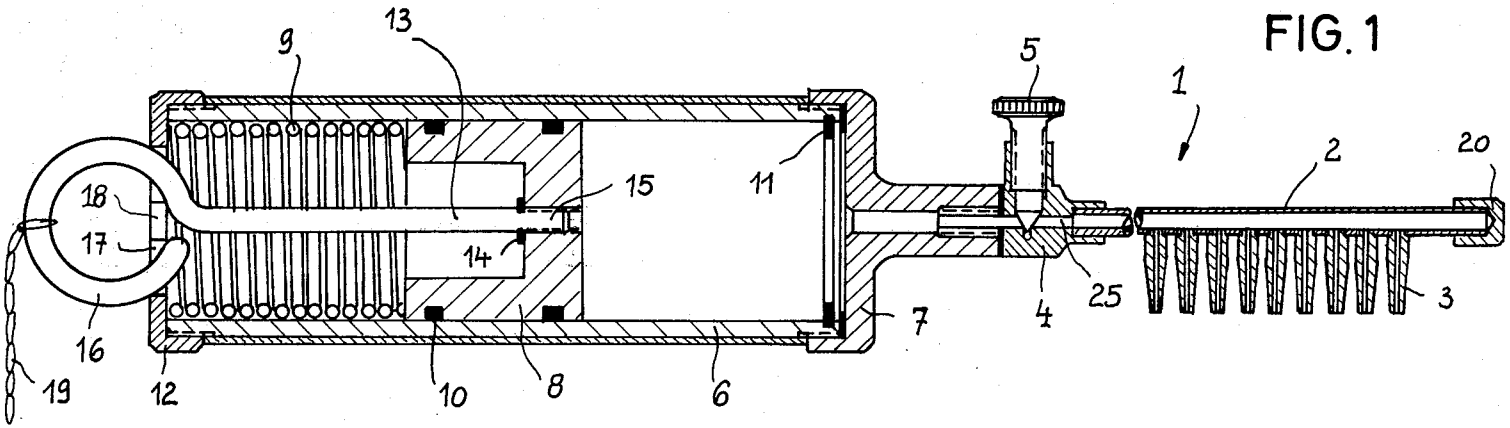
Figure 2:
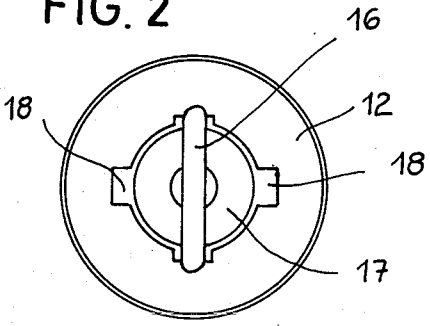
FIG. 2 is an end view of the hair-dyeing apparatus according to FIG. 1.

In the embodiment illustrated in FIGS. 1 and 2 a comb element 1, comprising a tube 2 with hollow tines 3 extending therefrom is connected by means of an intermediate member 4 to a container 6 of cylindrical shape having a cavity for receiving the hair-dyeing medium. A piston 8 is slidably guided in the container 6 and is fluidtight by means of seals 10. The piston 8 is biased by the action of a compression spring 9 which bears upon a lid 12. Between the comb element 1 and the container 6 there is disposed a pressure-reducing valve 5 enabling adjustment of the cross-section of the port 25 through which the container 6 communicates with the tube 2 of the comb element 1. On the filling side the container 6 is closed by a lid 7, provided with a suitable seal and adjoining the intermediate member 4 on which the pressure-reducing valve 5 is disposed.

A rod 13 is rotatably mounted in the piston 8 by means of screw threading 15 and is protected against leakage by means of a ring seal 14. An eyelet 16, whose external diameter is smaller than the internal diameter of the compression spring 9, is integral with the aforementioned rod 13. The lid 12, on which the compression spring 9 bears, is provided with a port 17 whose diameter is substantially smaller than the diameter of the eyelet 16. Accordingly, the lid 12 functions as a stop with respect to the eyelet 16 which prevents the compression spring 9 from moving the piston 8 against an annular abutment 11 close to lid 7.

However, as shown more clearly in FIG. 2, the part 17 is provided with two diametrically opposite notches forming a slot 18 which corresponds approximately to the cross-section of the eyelet 16. If the eyelet 16 is rotated through approximately 90° from the position illustrated in FIG. 1 into alignment with the slot 18, the compression spring 9 will be able to move the piston 8 against the abutment 11 so that the hair-dyeing medium disposed in the cylinder cavity is compressed. At a rate depending upon the position of the pressure-reducing valve 5, the hair-dyeing medium will then be able to enter into the tube 2 and emerge from the tines 3.

To enable the rod 13 together with the eyelet 16 to be withdrawn from the relaxed limiting position of the piston 8 I prefer to attach the eyelet 16 to a tensile element 19, for example a chain, by means of which the piston and the spring 9 can be again stressed for recharging the cylinder and can be locked.

The comb element 1 has a cap 20 for the tube 2 to facilitate cleaning of the hollow parts. It will be obvious that the individual parts are connected to one another, for example by screws, so as to facilitate rapid dismantling for cleaning purposes.

Figure 4:
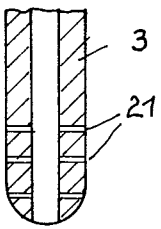
FIGS. 3 and 4 are enlarged longitudinal sections through individual hollow tines.
Figure 3:
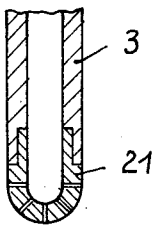

FIGS. 3 and 4 represent longitudinal sections through the individual tines 3, FIG. 3 showing a ball nozzle 21 which closes the tine 3 at its end and has nozzle-like ports which permit the hair-dyeing medium to pass through in different directions.

A modified structure is shown in FIG. 4 according to which the individual tines 3 are provided not only with an axial port but also with lateral ports 22 whose number and direction can be selected in accordance with requirements.

Figure 5:
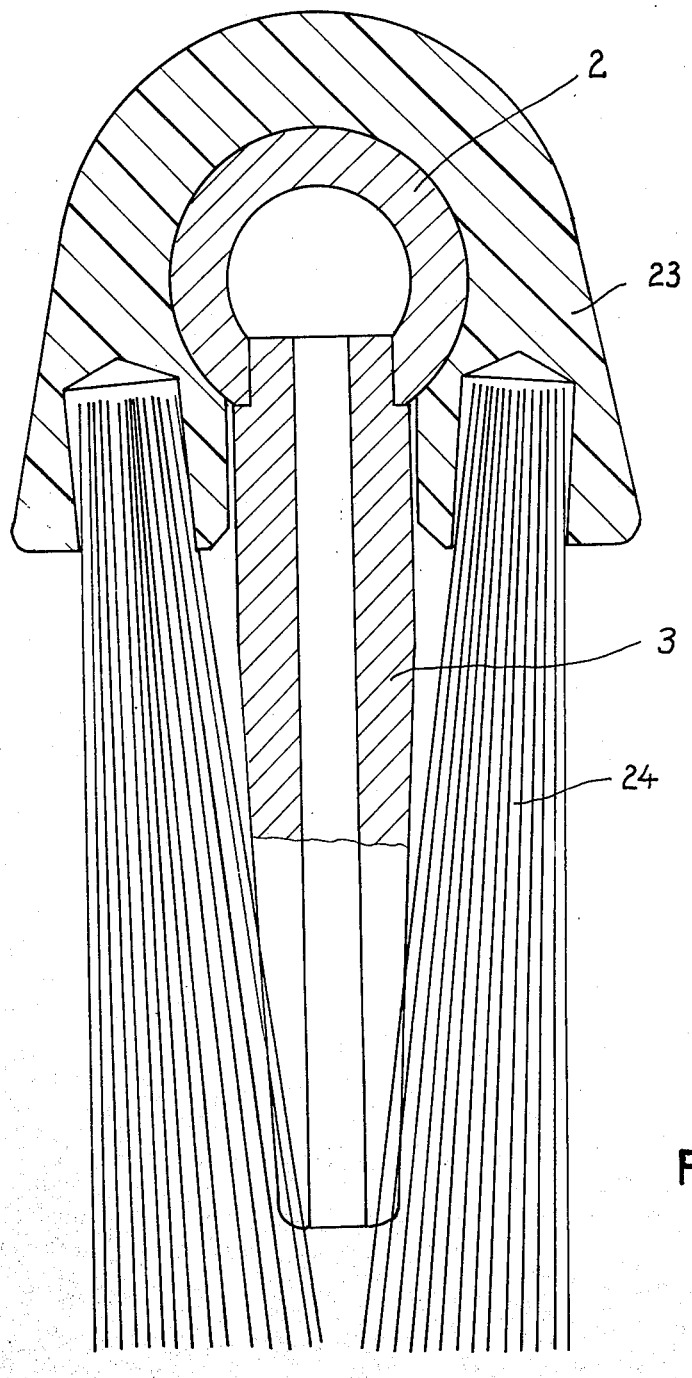
FIG. 5 is a cross-section through a comb element of the hair-dyeing apparatus in greatly enlarged form with bristles surrounding the tines.

FIG. 5 is a substantially enlarged view of a tine 3 connected to the tube 2 and surrounded by an annular array of bristle bunches 24 connected to a support 23 which in turn is mounted on the tube 2. If the support 23 is made of resilient plastic, it can be clipped onto the tube 2 and can also be removed as desired. The bristles of each bunch 24 project beyond the end of the associated tine 3 so that the dyestuff which emerges from the tines 3 is distributed in an improved manner over the hair by means of these bristles.

In use the hair-dyeing apparatus according to FIGS. 1 and 2 is actuated as follows: To obtain sufficient space in the cylinder 6 for charging with hair-dyeing medium, the lid 7 is unscrewed and the piston 8 is moved by means of the rod 13 and the eyelet 16 into its retracted position and locked as seen in FIG. 2. Hair dyeing medium is poured into the cavity shown in FIG. 1. The container 6 is then closed with the lid 7 on which the comb element 1 is disposed. The pressure-reducing valve 5 is set into a closed or slightly open position to prevent an excess amount of dyestuff from being discharged through the comb element 1 when the piston 8 is unlocked.

After adjusting the desired discharge rate the tines 3, which in turn allow hair-dyeing medium to emerge, are drawn through the parted hair. If dyeing is to be interrupted it will be sufficient to close the valve 5. If a prolonged pause is desired, the compression spring 9 can again be stressed by means of the rod 13 and can be locked by means of the eyelet 16. On completion of the work the apparatus can be readily cleaned by removal of the cap 29 and unscrewing of the lid 7 from the container 6 so that the comb element 1 is accessible all around for the introduction of solvent or the like.

In the embodiment illustrated in FIG. 6 the reducing valve 5 comprises a piston 41 which is slidably but nonrotatably guided in a housing 42, transversely so the port 25, against the action of a spring 43. An open port 44, or a circumferential annular groove which is aligned with the port 25 when the operating knob 45 is depressed against the action of the spring 43, is disposed in the piston 41. This enables the dyeing liquid to enter from the container 6 into the comb element 1; metering depends upon the intensity with which the operating knob 45 is depressed.

To prevent rotation of the piston 41 upon its operation the latter is nonrotatably locked with respect to the housing 42 by means of a detent 46 in the form of a pin which engages in a groove.

According to the embodiment illustrated in FIGS. 7 and 8, a piston 8' can also be locked by means of a cross-pin 47 which extends through the rod 13 by means of a torsion bar 51 and is engageable with a complementary recess 48 in an end wall 12'. When a rod 13' is pulled out of a cylinder 6' by means of a handle plate 49, the cross-pin 47 will move against a conical bore 50 and is resiliently depressed into the rod 13'. In a position outside and wall 12' the cross-pin 47 will again project under the action of the torsion bar 51 to function as an abutment lock. The wall 12' is provided with a recess 48 which enables the cross-pin 47 to be moved back towards the interior if the rod 13 or the handle plate 49 is correspondingly rotated with respect to the cylinder 6.

In this embodiment the piston 8' is provided with a sleeve 52 which is retained in a peripheral groove of its piston head. FIGS. 9 to 12 show agitating means for mixing the hair-dyeing or hair toning medium for the apparatus of the preceding Figures if such dyeing or toning medium comprises two or more components.

To enable the dyeing or toning medium to be mixed, the piston 8 is moved against the action of the spring 9 and is locked in its limiting position. Accordingly, the container 6 will have a cavity for filling in the components for the dyeing or toning medium.

The embodiment illustrated in FIG. 9 precedes from the assumption that the comb element 1 together with the intermediate member 4 and the reducing valve 5 (see also position shown in phantom lines in FIG. 10) is removed from the container 6 and in its place a mixing unit is attached whose lid 29 fits the screw threading 15 or some other connecting device of the container 6. A rod 27 is guided in the lid 29 coaxially with the container 6. On the inside of the container 6 the rod 27 supports a mixing element which is constructed as a perforated disc 26 in the present embodiment. Between a manipulating knob or handle 30 and the lid 29 there is disposed a compression spring 28, guided on the rod 27 which bears on the lid 29 and thus tends to urge the perforated disc 26 against the lid 29. If the handle 30 is displaced towards the container 6 and against the action of the spring 28, the perforated plate 26 will move towards the locked piston 8. In the course of the sliding motion of the perforated plate 26 the liquid, not yet mixed but disposed between the parts 26 and 8, will pass through the apertures 32 of this plate from one to the other side thereof. I have in practice that an intimate and homogeneous mixing of the components of the dyeing or toning medium takes place as a result of the flow which is thus induced. It is merely necessary to move the perforated disc 26 to and fro several times in order to obtain the finished mixture.

In the embodiment of FIG. 9 it is then merely necessary to remove the lid 29 from the container 6 and to replace it with the lid 7 of FIG. 1 to enable the dyeing operation to be performed.

In the embodiment of FIG. 10 the lid 7 of the comb element 1 remains constantly on the container 6 but the rod 27, which supports and guides the mixing element 26, is sealingly guided in an axial bore of a tubular piston rod 13''. The eyelet 16 illustrated in FIG. 9 cannot be directly used in this case. Accordingly, the piston rod 13'' is provided with a locking web or key 34 which extends in the direction of its longitudinal axis and through a corresponding slot or keyway 35 of the lid 12, this keyway bein a lateral extension of a central hole traversed by the rod 13''. In the retracted condition of the piston 8 the locking web 34 is free of the lid 12 so that the piston rod 13 need only be slightly rotated with respect to the lid 12 in order to disalign the web from slot 35 for the purpose of locking. In the locked position of the piston 8, illustrated in FIG. 10, the perforated disc 26 can again be moved with the handle 30 against the action of the spring 6 by means of the rod 27 within hte container 6 in order to perform the mixing operation. Spring 28, bearing upon knob 30 and a similar knob or handle 33 on stem 13'', tends to hold disc 26 in contact with the head of piston 8, as shown.

FIG. 11 is a plan view of a perforated plate 26 in which the perforations 32 are distributed so that the intervening webs still have adequate strength to withstand the flow pressure. It is also convenient to make the spacings between the perforations 32 approximately identical with one another so that a uniform flow is obtained in the region of each perforation.

The dyeing or toning medium is mixed in a simple manner in that the sieve plate, or an equivalent mixing element within the closed container filled with the treatment liquid is moved to and fro several times and the liquid is forced through the perforations of plate 26. The mixing of the components is highly intimate and homogeneous on account of the flow through the perforations 32. Since the container is closed in airtight manner during the mixing operation it is not possible for any gaseous substances to escape from the mixture. This applies more particularly to salamoniac which is frequently employed for such hair-dyeing media and in conventional mixing readily escapes by stirring and causes an annoying odor. It will be evident that mixing the dyeing or toning media in accordance with the invention also eliminates any unpleasant side effects, such as splashes, pollution or the like.

In FIG. 12 the mixing element is formed directly by the piston of the hair-dyeing apparatus. This piston has a head subdivided into two adjoining parts 36, 37 each having perforations 32. The piston part 37 is fixedly connected to the piston rod 13''. The piston part 36 is disposed on a rod 27 which extends through the piston rod 13'' and in turn is provided with the handle 30. The two sets of perforations 32 in the piston parts 36, 37 can be aligned as shown in FIG. 12. In this position the apparatus according to FIG. 12 functions as a mixing device and the liquid component are filled in by removing the lid 7. However, the reducing valve 5 must be closed for the mixing operation. If the handle 30 is then rotated with respect to the handle 33 on piston rod 13''the perforations 32 of one piston member 36 will be covered by the webs disposed between the perforations 32 of the other piston member 37. In this case the apparatus according to FIG. 12 functions as a hair-dyeing unit. Indexing means 38 of conventional kind, for example in the form of a spring-biased ball which engages in corresponding recesses corresponding to the two relative positions of the piston parts 36, 37, are provided between the handles or knobs 33, 30 in order to retain these parts in their selected position.

The retaining means disclosed in FIGS. 9 and 10 for locking the piston 5 with respect to the lid 12 cannot be employed in such an embodiment. Instead, the piston rod 13'' is provided with peripheral groove 40 into which a locking element 39 engages when that groove is exposed in the retracted piston position as shown.

The invention is not confined to the illustrated embodiments. For example, it is possible to provide a container 6 which can be closed on only one side with the lid 29 and is used merely for mixing the constituents of the dyeing or toning medium. After removal of the lid 29 the finished mixture can be filled into the container of the hair-dyeing apparatus.

I claim:

1. In a hair-treating apparatus utilizing a treatment liquid which is a mixture of a plurality of components, comprising a cylindrical container, a piston with a rod carrying a piston head in said container biased toward one end of the latter and locking means engageable with said piston for holding said piston head in a retracted position remote from said one end to enable introduction of treatment liquid through said one end into said container, said one end being closable by an attachment forming a tube with lateral apertures communicating with the interior of said container whereby said treatment liquid can be discharged through said apertures by the advancing piston head under the biasing force thereof upon a release of said locking means, the combination therewith of a perforated agitator disc received in said container between said one end thereof and said piston head, said disc being provided with a stem passing axially through a bore in said rod and terminating outside said container in a manipulating knob for axially reciprocating said disc and intermixing the components of said liquid by forcing same to flow through the perforations of said disc.

2. The combination defined in claim 1 wherein said container is provided at an end opposite said one end with a lid having a hole traversed by said rod and a keyway extending laterally from said hole, said locking means comprising a key on said rod fitting into said keyway but disalignable therefrom in said retracted position.

3. The combination defined in claim 1 wherein said rod terminates in a second knob outside said container, further comprising a compression spring inserted between said knobs.

4. The combination defined in claim 1 wherein said disc is in permanent contact with said piston head, the latter having perforations alignable with those of said disc in one relative rotary position and disaligned therefrom in another relative rotary position, said disc and said piston head being relatively rotatable and jointly reciprocable for mixing said components in said one rotary position and discharging said liquid in said other rotary position.

5. The combination defined in claim 4 wherein said rod has a peripheral groove exposed in said retracted position, said locking means comprising an element engageable in said groove upon exposure thereof.

6. The combination defined in claim 4 wherein said rod terminates in a second knob outside said container adjoining said manipulating knob, said knobs being provided with indexing means for releasably retaining same in a selected relative rotary position.

7. The combination defined in claim 1 or 4 wherein said piston head is biased by a loading spring bearing upon said piston head.

8. The combination defined in claim 1 or 4 wherein said tube is comb-shaped and provided with hollow tines forming said lateral apertures, said tines being surrounded by individual arrays of bristles.

* * * * *